US010113271B2

(12) United States Patent
Gordon et al.

(10) Patent No.: US 10,113,271 B2
(45) Date of Patent: Oct. 30, 2018

(54) DECORATION AND ADORNMENT METHODS FOR THERMOFORMED PULP

(71) Applicant: VARDEN PROCESS PTY LTD, Hampton, Victoria (AU)

(72) Inventors: Stuart Gordon, Hampton East Victoria (AU); Mark Appleford, Hampton (AU)

(73) Assignee: VARDEN PROCESS PTY LTD, Hampton, Victoria (AU)

( * ) Notice: Subject to any disclaimer, the term of this patent is extended or adjusted under 35 U.S.C. 154(b) by 778 days.

(21) Appl. No.: 14/419,394

(22) PCT Filed: Aug. 2, 2013

(86) PCT No.: PCT/AU2013/000853

§ 371 (c)(1),
(2) Date: Feb. 3, 2015

(87) PCT Pub. No.: WO2014/019027

PCT Pub. Date: Feb. 6, 2014

(65) Prior Publication Data

US 2015/0204020 A1 Jul. 23, 2015

Related U.S. Application Data

(60) Provisional application No. 61/679,199, filed on Aug. 3, 2012.

(51) Int. Cl.

| | |
|---|---|
| ***D21H 27/02*** | (2006.01) |
| ***D21J 3/00*** | (2006.01) |
| ***D21J 5/00*** | (2006.01) |
| ***B41F 16/00*** | (2006.01) |
| ***D21H 11/00*** | (2006.01) |

(52) U.S. Cl.
CPC ..... *D21H 27/02* (2013.01); *B41F 16/002* (2013.01); *D21H 11/00* (2013.01); *D21J 3/00* (2013.01); *D21J 5/00* (2013.01)

(58) Field of Classification Search
None
See application file for complete search history.

(56) References Cited

U.S. PATENT DOCUMENTS

| | | | | |
|---|---|---|---|---|
| 2,704,493 | A | 3/1955 | Randall | |
| 3,814,790 | A * | 6/1974 | Kato et al. | B41M 5/0353 156/240 |
| 8,062,477 | B2 | 11/2011 | Appleford et al. | |
| 2005/0076929 | A1* | 4/2005 | Fitzgerald | A24D 1/02 131/365 |
| 2009/0229773 | A1* | 9/2009 | Appleford | D21J 3/00 162/134 |

FOREIGN PATENT DOCUMENTS

| | | |
|---|---|---|
| WO | 2008000024 | 1/2008 |

OTHER PUBLICATIONS

International Search Report for PCT/AU2013/000853, Completed by the Australian Patent Office dated Sep. 10, 2013, 4 Pages.

* cited by examiner

*Primary Examiner* — Jacob T Minskey
(74) *Attorney, Agent, or Firm* — Brooks Kushman P.C.

(57) ABSTRACT

A method of forming a molded and printed product from pulp material including the steps of: forming a wet pulp pre-form mold; applying printing decoration to the wet pulp pre-form via an intermediate transfer surface: transferring printed pre-form to a final mold; and molding or re-molding the printed pre-form into a final shape.

14 Claims, 8 Drawing Sheets

DECORATION AND ADORNMENT METHODS FOR THERMOFORMED PULP

CROSS-REFERENCE TO RELATED APPLICATION

This application is the U.S. national phase of PCT Application No. PCT/AU2013/000853filed on Aug. 2, 2013, which claims the benefit of U.S. Provisional Application No. 61/679,199 filed on Aug. 3, 2012, the disclosures of which are incorporated in their entirety by reference herein.

INTRODUCTION TO THE INVENTION

This invention relates to the decoration of thermoformed pulp material created through the process of the type described in U.S. Pat. No. 8,062,477 and WO 2008/000024 which are herein incorporated by reference; and in particular, relates to an improved method and process for the decoration of non-planar thermoformed pulp and the like incorporating the transfer of the printed decoration from a carrier material, typically plastic film or silicon coated paper, onto partially formed and wet pulp material.

BACKGROUND TO THE INVENTION

The creation of compelling and high quality packaging for consumer durables is well established and is executed in a variety of forms and formats known in the prior art; however each of the prior art formats and methodologies have their own particular limitations. The consumer market demands increasing colour, vibrancy and novelty in addition to sophistication in order to provide eye catching shapes that will serve to differentiate products available for sale in a given marketplace. In addition to such aesthetic considerations an element of physical protection is also required for the goods in question. Such physical requirements of the packaging in question, often require complex internal structures or substructures to protect the packaged product which can introduce considerable cost and complexity to the packaging products commonly available.

The core packaging functions to contain, protect, preserve and promote the products in question, are often offset by substantial cost and lack of sustainability. The materials used are often from a non-renewable sources, or manufactured with processes that causes harmful environmental emissions, or in such a way as to preclude recycling and re-use. The cost of packaging can add considerably to the final cost of a product as it enters commerce and it is desirable to provide the best packaging possible at the most economical cost. Sustainability is also another key issue and an increasingly politicised issue of keen interest in the minds of consumers who may consider the type of packaging used for a product as part of any "buying decision". In addition, there is a general move and sympathy towards the provision of legislation and guidelines against non-sustainable packaging of consumer products.

The commonly available packaging techniques and materials can be summarised as follows:

Paper And Cardboard

Paper or Cardboard packaging is the most common form of packaging found in the market today. Paper and cardboard packaging is low cost and has the ability to accept printing and finishing to a very high standard but has a principal restriction by limitation of its form. Card is printed and then folded so as to create boxes or constructions limited by largely planer configurations. The inability to readily conform cardboard to other than linear and planer shapes does not allow this material to be adapted for brand or product discrimination in the marketplace as all packaging based on cardboard incorporates substantial planar elements. The ubiquitous nature of cardboard also means that it is difficult for suppliers to create perceived value around the product without resorting to complicated treatments of the boxes, including lamination and use of metallic and plastic films etc. The more complicated the printing and laminating and/or folding involved in any manufacture of a packaging product, the more costly the end product results which must be passed onto the consumer. In addition, a number of the perceived high quality treatments in cardboard and paper packaging, require the use of processes that are not environmentally sustainable, or which hinder the recycling of the packaging and therefore make the packaging less environmentally friendly than it otherwise could be.

Use of recycled materials is also limited by a reduction in strength of cardboard; the main process used for packaging materials is the Fourdrinier process. This process creates a flat sheet of material where fibres are aligned in the direction of the production flow, giving rise to distinct properties within the finished board, which can be used to either increase the compression strength of the board or its flexibility. These particular features are compromised by the use of recycled pulp because of the changes occurring in the pulp particles during recycling processes. In addition, legislation governs the application and use of recycled materials in this process due to hygiene issues.

Plastic is a highly creative medium allowing for the development, design and creation of packaging shapes that are unique, individual and include curves, compound curving or organic forms and which may in turn produce an enormous range and configuration of packaging and presentations, thereby allowing the branding of a particular product or the shape of the actual container to be used as powerful marketing and branding tools. Plastics are able to be brightly coloured and have the ability to take up print and decoration across compound surfaces to give a similar result to that of moulded metal but at a much lower cost. Plastics can be decorated by a number of means; direct printed, labelled or in-mould labelled. This latter process involves the insertion of a polymer label into the empty plastic forming mould, the label is robotically placed and as it is a planar printed label is positioned on a planar section of the tool. The plastic material is introduced and the surface of the plastic product fuses with the label material to create a smooth decorated surface. This technique of "in mould labelling" is well known and creates interesting and unique packages for use with a variety of goods.

A key limitation and drawback with plastic packaging is the non-sustainability of this packaging methodology and an increasingly poor consumer perception of the throwaway and disposable nature of plastic packaging. Most thermoplastics are derived from oil and as such the price of this commodity is invariably increasing, in addition to the perception of the non-renewable nature of this commodity, it suffers a generally poor public perception. Most thermo plastics are readily recycled, although the variety of plastics complicates the sorting process. The recycled material is classed as re-grind material and as such its use is more limited than virgin material. This is most notable in the products that have direct food contact were the use of regrind material is not permitted or in some cases it has to be the external material, tied to the inner which is virgin plastic.

An increasing use of organically-derived plastics to address some of the environmental concerns are provided for in the prior art, however, organically-derived materials can also have problems, in particular the so called "bio-polymers", which may not be as sustainable as they first appear. Most first generation bio-polymers are derived from polylactic acid and this material is not catered to in the current plastic recycling methodologies. In addition, polylactic acid is not compatible with petroleum based plastics and is generally considered a contaminant. In addition, the current rationale understood with respect to bio-polymers is that they are compostible and so can be added to landfill. However the energy required in their creation is not returned or reduced by this process and in a number of cases, polylactic acid is inferior and/or requires more material to equal the performance of petroleum based plastics.

Glass

Clarity, strength and substance as well as premium perception has kept glass a first choice material for a number of high end products including perfumes, skin care products etc where the weight of the glass and its inherent coolness serves to enhance the perception of quality. However glass as a packaging medium, is heavy, fragile and requires a lot of energy to melt and reform.

Metal

Pressed metal boxes and tins are often used in consumer packaging because they can be brightly coloured and formed into a number of eye catching shapes, including curved and organic shapes.

Metal can be formed either by welding into cylinders or through impact moulding. Impact moulding involves the use of a flat sheet of metal which is formed between two shaped metal dyes which subject the metal to a high impact and forces the flat sheeted material to conform to the profile of the dye.

The deformation of metal during this process, whilst it can be severe, generally with respect to the artwork applied to metallic boxes and tins, deformation is of little concern and the artwork can be readily applied to the flat sheet of material in a pre-distorted form which then goes through the moulding process and deforms with the metal such that the requisite imagery or graphics are rendered onto the final product.

Metal itself is however an expensive raw material and in comparison to paper, the unit cost of a metallic container is far greater than the similar piece of packaging made from plastic or cardboard. The use of metallic boxes and packaging is generally less sustainable than the previously described materials and requires substantial energy for recycling. In addition, the use of metallic materials for packaging involves the use of a finite resource and the mining industry and forging of metals for packaging is increasingly being perceived by the consuming public as environmentally questionable.

Pulp Fibre

Formed pulp paper has a restricted and limited public perception at this point in time due to its principal association with low end single colour products like fruit trays or egg boxes. The fibre used in the preparation of pulping products can be the same which is used in typical paper production but it is also possible to use fibres derived from products other than wood. The development of pulp fibre processing in its simplest form involves a creation of a mat of fibres by lifting a mesh through a vat of fibres in suspension. The fibres are then collected by the mesh and excess water drains away. The positively shaped mesh is then brought into contact with the negatively shaped mould and subsequently heated with the application of pressure to remove excess water. The process then dries the mat into its final form. The currently used single stage processes generally give pulp a distinctive coarse finish with the marks of the mesh clearly visible as witnesses on one or more of the faces.

Modern high pressure pulp thermoforming has provided many improvements to the previously described single stage process. Modern high pressure pulp thermoforming generally involves a two stage forming process which can result in high quality finished products with a smooth finish which is comparable to that of high quality flat cardboard. The modern two stage pulp thermoformer works in such a way that the pulp is moulded over the extraction mesh then transferred to a conventional solid male-female mould with extraction vents. The mould is then heated to about 200° and steam extracted through vents in the mould by vacuum which results in a dense, smooth finish product that can be curved or contain multiple compound curves.

The benefits of pulp as a packaging medium include low cost and the ability to conform the product into a wide variety of highly complex compound shapes. The added benefit of pulp as a packaging medium include the ability for the product to be solid coloured right through with the use of dyes in the pulp vat. In addition, the material can have variable wall thickness depending on the specific localised pressure used at the point of forming which gives excellent insulation properties for heat and shock.

The key disadvantage of pulp fibre packaging from a commercial point of view is the limitation to the use of a single colour throughout the packaging material. In addition, once the pulping material has been formed and dried into the final moulded shape, it is not possible to economically print upon or decorate such surfaces.

Whilst it is possible to place adhesive stickers on such packaging, adhesive stickers are only able to be applied economically to planar surfaces which provide distinct limitations to the form and design of such packaging products. In addition, adhesive stickers are not visually appealing because they are not fully integrated with the design and manufacture of the product and the application of adhesive labels requires precision and specific care in alignment and places limitations on any high speed industrial process. A further technique for use with pulp fibre packaging includes the use of vacuum or heat to form a laminated plastic film over the finished dried packaging product complete with compound curves. However, such films have disadvantages including their appearance as add-ons or additions and distraction from the integrated perception of the whole design; such products are also limited by the compound nature of the surface to which they can adhere where extremely deep valleys or ridges are not possible without the film ripping or folding which compromises the final product; and finally, the nature of the adhered film is such that it is necessarily a plastic adhered to paper pulp which then compromises recycling and sustainability.

Moulded pulp products are well known, particularly as both internal and external packaging products. For example, moulded pulp egg crates, or cartons have been used for decades for packaging eggs. Similar packaging products are used for a variety of fruit and vegetables and other products that require protection during transportation. Computer components, printer cartridges, vehicle components and many other products are packaged using moulded pulp packaging. Moulded pulp is used for containers for plants in plant nurseries.

The pulp for such packaging is conveniently and cheaply manufactured from waste paper and other waste material. In one process, a pulp slurry is prepared from waste paper, cardboard, textiles and other similar waste material. The slurry may include additives of any type, including, but not limited to, chalk and fabric material. Such additives impart desirable characteristics to the finished product. For example, chalk added to the pulp slurry results in a product having a china-like feel, while the addition of fabric to the slurry results in a product having a quality fabric feel.

In producing a product of moulded pulp, a mould is prepared for the product to be made. A mat of pulp is lifted from the slurry container, generally using a framed mesh, and is deposited into the preliminary mould. The thickness of the pulp mat is determined by the relative speed of the framed mesh dip into the slurry container, and subject to the fibre and moisture content of the pulp slurry. The mat is placed into the mould and pressure or heat and pressure is applied to remove the water content and force the pulp and mat to adopt the shape of the mould.

With products of this type, printing or other decoration may be applied only to any planar surfaces or surfaces that contain only two dimensional curves, such as cylindrical or conical surfaces or the like.

The conventional moulding process is divided preferably into two parts, where the pulp is moulded and formed twice, in two separate and different moulds. A preliminary mould is prepared for the product to be made. The preliminary mould is designed to be within predetermined tolerances, shapes and dimensions of the final mould shape as there is a limited elasticity in a preliminary moulded pulp pre-form for the subsequent moulding stage.

A mat of pulp is lifted from the slurry container, preferably by a framed mesh, which is itself shaped to be the opposing part of the preliminary mould and is offered up into the preliminary mould. The thickness of the pulp mat is determined by the relative speed of the framed mesh dip into the slurry container, and subject to the fibre type, consistency of the slurry and moisture content of the pulp slurry.

The mat is formed into a pre-form shape in the preliminary mould by applying heat and pressure. A vacuum is applied to the rear of the mesh to facilitate the extraction of water content form the pulp in the form of steam. This process sets the overall material parameters of the pulp and the initial characteristics of the product shape. These characteristics include the volume of pulp in the product, uniformity of wall thickness, initial density and dimensional size. These characteristics are calculated to allow for specific tolerances in specific areas, such that those areas that will be subjected to deformation in the secondary moulding process are left with higher moisture contents and lower particle density, so that the pulp retains elasticity at this point. During this stage of the moulding process, an amount of the moisture content of the pulp slurry is removed from the mat. When the pre-form has been formed by and to the desired shape by the preliminary mould, preferably using pressure or heat and pressure, the pre-form is removed therefrom and transferred to a final mould which will impart the final product shape to the pre-form. The final shape may involve the provision of ribs, areas of different thicknesses, areas of different densities, complex curved shapes, planar surfaces and many other different features. The development of such features may be the function of differing heat and pressure applications, and over varying times, calculated to give the desired characteristics for the moulded pulp product. Accordingly, levels of rigidity, dryness, insulation, barrier properties and other properties may vary within a product and between products.

Thus, for any given product design, the pre-form and final form moulds will involve designing the moulds to apply different amounts of heat and pressure in different locations to create areas of differing shapes, thicknesses and densities in walls, differing rib and fin densities, and other product shape characteristics in order, for example, to retain or disburse heat (as an insulator) or physical shock, as required by the end product.

The moulded product is formed in two stages as outlined above, and the printing is applied to the pulp after the first moulding process, but before the second moulding process by a printing process. The printing is designed so that, during the final moulding process, the printed material, when conformed to the final complex moulded shape, presents an image which may be easily identified, read and understood, or scanned. Decoration, in the form of embossing, raised or depressed areas which accentuate or complement the printing may occur either in the preliminary or secondary moulding, in both, or progressively, that is the same areas partially raised or depressed in the preliminary moulding are then further depressed or raised in the secondary moulding. Thus, the printing and decorating that occurs on the pre-form prior to forming the final shape is formed into identifiable indicia, logos, recognisable printing or recognisable decoration when the pre-form is subsequently processed in the final mould to its final shape.

Products from such processes may take the form of a complex shape, such as a food container in the shape of an animal head, such as the head of a monkey. With such a product, the pre-form may be in the shape of two connected parts of a polyhedral having multiple planar surfaces each of which can be easily printed with a decoration or design. During final moulding, the printed polyhedral halves are formed into the lower and upper head shapes of multiple, complex curves in the shape of, for example, a monkey's head, and the printed surfaces take the shape, form and appearance of the facial features of the monkey's head, including eyes, nose and ears. The edges of each container half are designed to meet and are shaped and printed in the form of the mouth. Such a novel container may have many uses in the food industry, such as a container for takeaway food products, confectionery, or the like; or as packaging for a wide variety of personal care goods such as perfume and toiletries.

Products made in accordance with these techniques may take any shape or form that is able to be moulded using pulp moulding techniques. Thus, high quality moulded pulp products with sophisticated printing and decoration may be produced relatively cheaply to replace products of other relatively expensive materials such as synthetic plastics.

The design of the print or decoration to be applied to the two dimensional surfaces of the pre-form is developed so that, when the surfaces are moulded to complex curves, the printing and/or decoration takes up a desired appearance, which may be in the form of printed letters, pictures, logos or other indicia. The printing is therefore designed to be developed, on moulding from a planar to a curved shape, to the required finished appearance of lettering or the like, including barcodes or other product identification information. During the moulding process, the printed material on the planar or two dimensional curved surfaces morphs or transmutes into the shapes and appearance on the complex curved shapes on the moulded surfaces to display the desired finished appearance. Thus, the printing may expand or contract with the change in the shape of the surface on which it is printed.

The inks or other fluid, or powder, that are used for the printing are selected from inks, powders or fluids having the necessary elasticity, colour depth, high drawing and opaqueness to be able to deform, during moulding, without colour change, separation and undesired intensity variation. The ink or other coating compound must also be able to withstand the pressures and heat used during the secondary moulding stage. The processes described above are particularly relevant to designs with lettering, barcodes, logos and the like on the finished moulded product. This may use an anamorphic projection to modify the aspect ratio of the finished graphic design by optical distortion to stretch or compress the image in various dimensions so that the design is faithfully reproduced in the finished form from a distorted initial image printed on the two dimensional surfaces. A computer assisted design program may be used to transfer the design directly or through the more traditional reprographic methods onto a carrier film, into an automated printing machine or print spray machine as required by the end product design. An optimum target point of decoration on the pre-form is identified, using a deformation grid to ensure that the anamorphic distortion is able to be distorted to a predictable extent during final moulding.

The surfaces of the pre-form to which printing is to be applied, which surfaces may be planar or curved in one direction, such as part cylindrical or conical surfaces, can have the printing applied thereto by one or more of many known printing processes.

However, the previously described methods involve complex techniques to faithfully reproduce the required images on the final product. In addition, the previously described printing methods rely on silicon coated paper or polymer web to carry the printing and apply the printing in one off applications of the printing to the pre-form which greatly limits the speed of manufacture and limits the options for automation.

It would be desirable to provide an alternative to current packaging processes and techniques utilising the advantages of pulp fibre providing such packaging can be provided with a high finished quality and with the ability to receive high definition printing and decoration as found in the previously detailed prior art products.

Accordingly, one object of the invention is to provide an improved method and apparatus for moulding and printing pulp fibre materials.

For the purposes of this specification, the term "pulp material" shall be taken to mean pulp formed of a mixture of cellulose fibres, including, but not limited to, cellulose fibres derived from waste and other paper, cardboard, yarns and textiles, plant fibres including wood chips and other timber and plant material including waste, and any other material predominately of cellulose. The term "printing" shall be taken to include printed decoration of all forms and dried printed decoration. The term "intermediate transfer surface shall be taken to include all variations and vehicles used to apply the print decoration to the pulp including variations where a) the intermediate transfer surface is a part of the physical apparatus used to perform the invention, in the manner of a roller which handles the printed decoration temporarily prior to applying same to the pulp; and b) where the intermediate transfer surface takes the form of a carrier of the print decoration that is integrated, along with the print decoration, by melding into the pulp so as to form a physical part of the pulp and final product.

STATEMENT OF INVENTION

In a first aspect the invention provides a method of forming a moulded and printed product from pulp material including the steps of:

a) forming a wet pulp pre-form mould;

b) applying printing decoration to said wet pulp pre-form via an intermediate transfer surface;

c) transferring printed pre-form to a final mould;

d) moulding or re-moulding said pre-form to a final shape to form said moulded and printed product.

The intermediate transfer surface may be a fibre carrier web and may include an uncoated paper web.

The intermediate transfer surface and printing may be applied directly to the wet pulp sheet material via an intermediate transfer roller or the intermediate transfer surface may apply the printing to an intermediate transfer roller and from the transfer roller to the pulp.

The intermediate transfer roller most preferably serves as the intermediate transfer surface per se to deliver the printing to the wet pulp sheet material and also serves to exercise a degree of control over the release of the printing in such a manner as to minimise the amount of release required for transfer of the printing to the wet pulp. In a particularly preferred embodiment the amount of release required is provided by surface tension alone thereby maximising the integrity of the transfer step of printing.

In instances where the printing requires additional assistance to adhere to the wet pulp sheet, adhesives can be introduced including adhesives of the starch based type which may be applied to the wet pulp in order to assist with the receipt and adhesion of the printing applied thereto.

The carrier web is most preferably fed from a feeder spool to a take-up spool via a tensioning roller in such a manner as to co-operate with the transfer roller to effect delivery of the printing to the wet pulp. The carrier web may be formed of a fibre material capable of integration and melding with the pulp substrate so as to deliver the printing to the pulp by integration therewith.

The transfer roller is most preferably coated in a non-stick surface of the Teflon™ type containing a plurality of holes to assist in release.

In a particularly preferred embodiment the combination of feeder spools, uptake spools, tensioning rollers and transfer rollers are mounted in a common frame thereby allowing co-ordinated and controlled movement of the spool and roller assembly so as to fully control the contact of the transfer roller to the wet pulp where the application of appropriate pressure to effect efficient transfer of print from the transfer roller to the wet pulp can be carefully co-ordinated whilst maintaining a common relationship between the feeder and uptake spools and the tensioning rollers.

In a particularly preferred embodiment a conveyer movement is provided for the wet pulp sheeting so as to move the wet pulp sheeting at a speed commensurate with the speed of rotation of the transfer roller.

In another embodiment the printing may be applied to the intermediate transfer surface via one or a plurality of print heads which co-operate with the transfer roller.

In a particularly preferred embodiment the method of the invention may include a curing step whereby the printing ink applied to the transfer roller is cured on the roller prior to application and transfer of the ink to the wet pulp.

In a particularly preferred embodiment the printing is applied to the wet pulp in a pre-distorted configuration which is calculated to allow for the distortions and movement which occur during the forming stage such that the desired post distortion configuration appears in the final shape.

In another aspect the invention provides a method of forming a moulded and printed product from pulp material including the steps of:

a) forming a pre-form mould to have one or more planer surfaces, compound conjoined planar surfaces and/or two dimensional curved surfaces;

b) transferring an amount of pulp slurry material to said pre-form mould;

c) forming a moulded pre-form from said transferred pulp slurry material;

d) applying printing decoration to said planar and/or dimensional curved surfaces in a pre-distorted configuration wherein said printing decoration is applied to an intermediate transfer surface and subsequently transferred from said transfer surface to said pre-form;

e) moulding or re-moulding said printed pre-form to a final shape to form said moulded and printed product.

The printed surface preferably retains the printing without running and the printing conforms to a desired post-distortion configuration.

The intermediate transfer surface may preferably include a release coating.

The printed decoration is most preferably carried on a carrier web fed from a feeder spool to a take up spool via a tensioning roller so as to cooperate with said transfer roller for delivery of the printing to said transfer roller.

The transfer roller is most preferably coated in a non-stick surface of the Teflon™ type containing a plurality of small holes.

The feeder and uptake spools; in addition to the tensioning and transfer rollers are most preferably mounted in a common frame allowing controlled contact of said print to the pre-form.

The printed decoration is most preferably carried on a carrier web and the method preferably also includes a conveyor movement of the pre-form which is set at a speed commensurate with the speed of rotation of the transfer roller.

The printing is preferably applied to said intermediate transfer surface via one or a plurality of print heads cooperating with the transfer roller.

The method of the invention preferably also includes the step of curing the printing ink on said transfer roller prior to application of the printing ink to the pre-form.

The pulp slurry material is preferably prepared in a pulp holding tank with the tank including a forming mesh belt moving across a suction head so as to deliver the continuous sheet to an automated production line for application of subsequent steps (d) and (e) of the method of the invention.

The invention is particularly applicable to pre-printed decoration which is transferred from a carrier material to the surface of the wet pulp material. The method of printing onto the film can be performed by many print techniques, including gravure, flexographic, screenprinting. In this manner a membrane of print is applied to an intermediate transfer surface which can be transferred without the need for a backing material. The print membrane may have a reactive release layer which connects the membrane to the carrier material and an adhesive coating both of which are passive until activated just prior to application onto the target product. The method of release of the membrane from the carrier film can be activated by heat, chemical reaction, such as to UV light with the possible addition of pressure, either in the form of compression or tension, or a combination of both.

The process of applying this membrane to the pulp in the methods of the invention has advantages over the prior art in related technologies, most notably the therimage process which was invented and developed by Avery Dennison, the release layer is heat activated and the membrane of print is transferred from the carrier material to the target product by the use of pressure and chemical adhesion.

The intermediate transfer surface may include a rotating cylinder.

The intermediate stage allows the print membrane to be transferred from the carrier web to the intermediate transfer surface where it is temporarily held, either by suction through holes in the cylinder, or by surface tension, and can then be applied to the wet pulp without the requirement to activate—any release layer. Application from the cylinder or intermediate stage would include registration by the use of optical or physical registration markers, on the pulp mat, and the intermediate roller. At the point of application, surface tension from the pulp mat will pull the printed decoration from the roller. This may be assisted with techniques such as, but not limited to, blowing air through the holes previously used to create suction to hold the decoration onto the roller. By varying the diameter of the roller or intermediate transfer device, multiple copies of the same printed decoration may be held at the same time, and by using this rolling mechanism a faster more linear process is possible than has been described with the plate based transfer mechanism described in the prior art.

Furthermore, the intermediate transfer surface of the device would reverse the initial print decoration sequence, which could offer additional benefits in the form of bespoke coatings to either enhance performance or the visual appeal of the product. The use of the intermediate transfer device also allows for the separation of coatings from the print membrane to point of application which allows for greater flexibility within the production process given that the fibre mix and end use of the target product may require customised coatings.

The benefit of a cylinder embodiment of the intermediate transfer surface is particular to the process outlined in U.S. Pat. No. 8,062,477, with improved efficiencies which overcome the wet pulp acting as a heat sink, which can compromise the heat-activated release process with a planar heated press.

A further embodiment of the process to apply a membrane of print to the semi-wet pulp could occur directly on the transfer roller, whereby the roller is directly printed and the ink cured on the roller by UV, this process is similar to the dry offset letterpress process, in which a number of colours are offset from the small circumference print cylinders to the larger circumference transfer cylinder. This method would remove the carrier web from the process and also with the development of direct to plate and digital technology could allow for rapid changes in the print design such as language changes to the same pulp product allowing for longer production runs without the need to change carrier webs.

In another aspect the invention provides an apparatus for the production of moulded and printed product from pulp material characterized by the incorporation of a transfer roller adapted to receive said printing and transfer the printing to the pulp material prior to moulding or re-moulding of the pulp to a final shape.

DETAILED DESCRIPTION OF INVENTION

In order that the invention is more readily understood, embodiments thereof will now be described with reference to the accompanying drawings and legend wherein.

LEGEND

Figure 1:
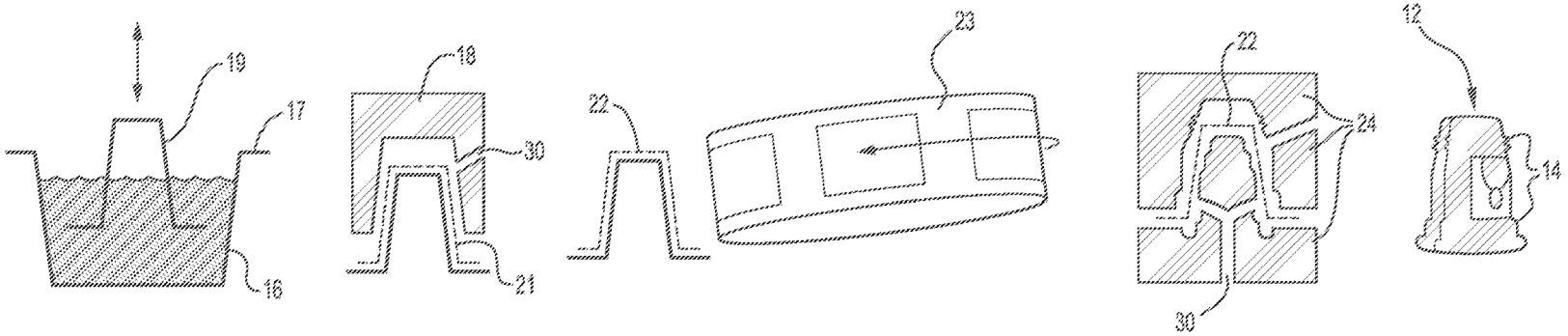
FIG. 1 is a schematic illustration of one embodiment of the process of forming a moulded pulp product.

1
2
3
4
5
6
7
8
9
10
11
12 Product
13
14 Ribs
15
16 Slurry
17 Container
18 Mould
19 Mesh
20 Outer surface
21 Mat
22 Preform
23 Printing process
24 Final mould
25
26 Pre printed label or film
27 Lugs
28 Screen mesh
29 Pad
30 Vents
31 Anamorphic projection
32
33 Planar top
34 Conical surface
35 Printing
36 Intermediate transfer surface
37 Carrier web
38 Feeder spool
39 Take up spool
40 Tensioning roller
41 Transfer roller
42 Wet pulp
43 Conveyor belt
44 Print heads
45 UV light source
46 Wet pulp sheet continuous web
47 Forming mesh belt
48 Pulp holding tank
49 Suction head
50 Heated mandrel/rollers
51 Delivery belt
52 Forming station
53 Intermediate transfer roller(s)
54 Printed pulp sheet
55 Melded or integrated printed carrier web and substrate pulp Referring to FIG. 1, a product 12 moulded from pulp material is in the form of a cup having a complex outer surface shape with a plurality of ribs 14 which may be of different thicknesses and spacings to provide insulation, crush-resistance and other characteristics to the cup product 12.

A slurry 16 of pulp material as hereinbefore defined is mixed in a container 17, and the desired additives to produce desired end-product characteristics are added to the slurry 16. Such additives may include chalk, fabric material, and the like known in the art of pulp moulding. The fibre content and moisture levels of the pulp slurry 16 are controlled so as to obtain maximum control over the deform characteristics of the pulp during the moulding processes and to thereby obtain control of the deformation profile and retention of the subsequently applied decoration or other printed material. Preferably, the moisture level of the slurry 16 in the container 17 is between 100% and 600% by weight (total weight/dry weight), more preferably between 200% and 450%, and, in some embodiments, between 300% and 400% by weight. It will be understood that the moisture content will depend to a large extent on the nature of the fibres in the slurry.

A preliminary, or pre-form mould 18 is prepared so as to have planar and/or two dimensional curved surfaces, such as cylindrical or conical surfaces, to which printing or other coatings may be easily applied. In the illustrated embodiment, the pre-form mould 18 has a substantially conical form, to produce a pre-form with a conical outer surface 20. A framed mesh 19, which is in the form of the preliminary mould is dipped into the slurry 16 and lifts out a mat 21 of the pulp material from the slurry 16 in the container 17. The mat 21 is offered up to the matching part of the preliminary mould by the shaped mesh platen 19 where it is formed into the pre-form 22 using, air pressure, heat or other moulding processes which set the overall material parameters of the pulp product and the initial characteristics of the product shape. These characteristics include the volume of pulp material in the product, the uniformity of wall thickness, initial density and product size. The pre-form mould also removes a proportion of the liquid from the pulp mat 21 by applying a highly controlled amount of heat and pressure, and extracting steam through the mesh and through special vents 30 built into the opposing part of the preliminary mould (note, typically these vents are placed so as not to align with print areas as they cause a change in surface texture which interferes with the printing process) so that the pre-form is able to receive printed material thereon.

When the pre-form 22 is released from the mould 18, it is not self-supporting because there is still a high moisture content within the pulp, to allow deformation at the final stage. It is held onto the preliminary mould by suction. At this point it has the shape of a hollow, frustroconical container matching the shape of the pre-form mould 18. The outer, conical surface 20 of the pre-form 22 is then able to be printed with appropriate printing and/or decoration using, for example, a dry, offset letterpress printing process schematically indicated at 23, or using offset photolithography, or other printing processes.

The image printed onto the two dimensional conical surface of the pre-form 22 is an anamorphic projection which is designed so that, when the final product 12 is moulded, the printed indicia takes the desired form and shape required for the finished product. To create an accurate model for the distortion profile there are two distinct methods, the first is to utilise a printed grid with either uniform or otherwise predetermined pattern. A typical grid would use either an XY format or concentric circle. The product to be manufactured is then printed with the grid and the process of shaping and distorting is completed to create a finished product. The grid on the finished product will typically be distorted and mapping the final co-ordinates of this grid against the pre-deformed co-ordinates allows the creation of a distortion map. The other method is based on profiling the material to ascertain its deformation characteristics. This data would then be used to create a virtual distortion map which would then enable specific computer aided design software to predict the final level of distortion across any given shape. The mapping of the distortion across the surface, real or virtual, then enables the accurate pre-distortion of the original image/insignia/type/device so that it, the design, is faithfully reproduced in the finished form from the projection printed on the two dimensional surfaces. This form and shape may include the reproduction of lettering, barcodes, logos, images or any other design or decoration to be identified on the outer surface of the finished product 12.

The printed pre-form 22 is then transferred to the final mould 24 where it is subjected to heat and/or pressure to cause the pre-form 22 to conform to the shape of the final mould 24. This shape includes the ribs 14 on the finished product 12, which ribs 14 have complex shapes. The transformation of the printing on the two dimensional surface of pre-form 22 to the three dimensional shapes formed in the final product 12 require the inks used during the printing process to be able to be deformed, stretched, compressed or otherwise transmuted to the desired form on the finished product 12.

Figure 2:
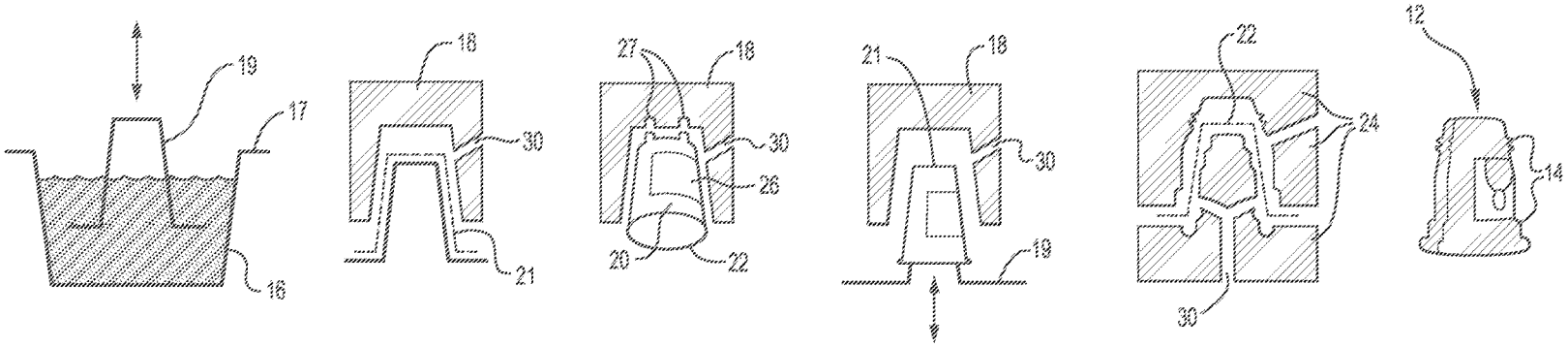
FIG. 2 is a schematic illustration of another embodiment of the invention.

Referring to FIG. 2, this method is similar to that of FIG. 1 except that there are two separate preliminary mould processes before the final moulding. The first is where the shaped mesh platen lifts the pulp mat into the preliminary mould and a low heat (approx 50 degrees Celsius) and pressure is applied to create a loosely tamped version of the pre-form 22. As the pre-form mould opens, the pre-form is held onto the mould by suction, to give adequate support for the ensuing printing process. Then the indicia is applied to the pre-form 22 comprising a pre-printed label or film 26 which is applied to the pre-form. Appropriate tabs, or lugs 27 or other means, may be used to orient the label in the desired position within the pre-form mould 18. The pre-form mould then closes again, and heat and pressure are applied, under close parameters. The key here is to melt the heat release coating on the film, such that the ink is able to transfer to the wet pulp, and also to apply adequate pressure for the ink to bind and adhere to the pulp, whilst retaining enough moisture content within the pulp to allow for deformation inside the final moulding process. In one particular embodiment a temperature of 175 degrees Celsius, for one second combined with a pressure of 400 Kpa is sufficient.

This process is the optimum one for this methodology, because it allows for a fast-moving semi-automated process. When the product is relatively flat, the film may be advanced over the pre-form 22 whilst being held on an opposing pair of rollers. As the process proceeds then each section of used film is advanced from one spool or roller onto the opposing spool or roller. In some cases, where the finished article has a deep recess, and it is not practical to lay the print film over the product, then the film is cut into pieces and positioned in the pre-form mould 18, thereafter the rest of the process remains the same.

Figure 3:
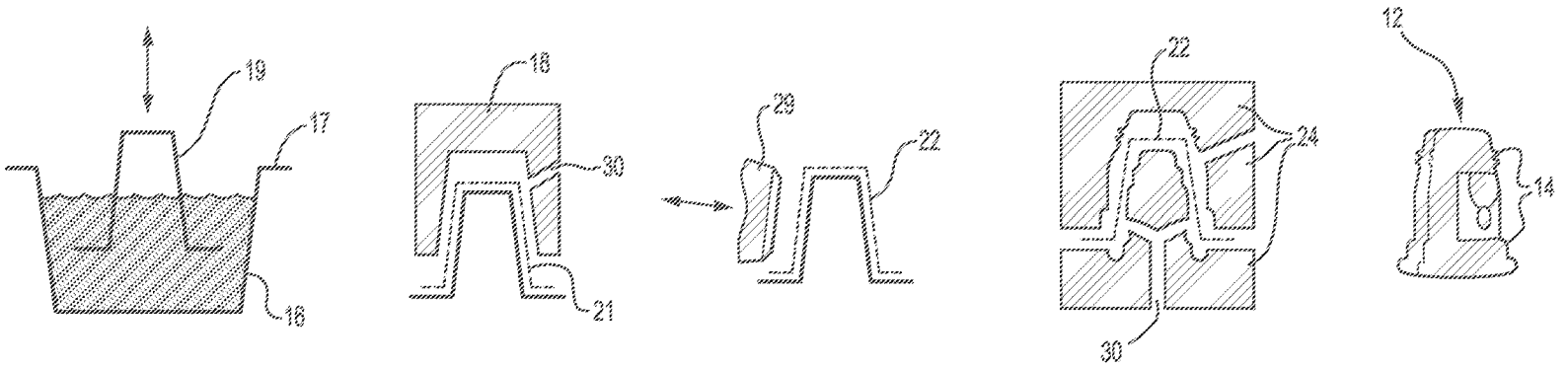
FIG. 3 is a schematic illustration of a further embodiment of the invention.

The label carrier film may either act as a laminate on the pre-form surface where it actually adheres to the surface, or may be ejected from the pre-form mould 18 on completion of the pre-form moulding process. The pre-form 22 is then transferred to the final mould 24 where the final product 12 is produced, with the shapes, texts and designs on the printed material transmuting to the desired appearance on the finished product 12. A higher heat is applied, typically 200 degrees Celsius, and all moisture extracted from the pulp by means of steam extraction vents, which are all placed on the opposing face of the pulp to the printed face.

Where in-mould and release film methods are used, a stable film is used, such as a Garfilm ERC film (trademark), onto which is applied a Heat Release coating, typically at a coverage in the region of 2.7 gsm film weight. Then a specific high-draw ink is used to print on the images or text, using a system with an engraved gravure cylinder with a line screen ranging between 110 and 200 lines per inch. The ink contains the usual additives to increase scuff resistance and adhesion, flexibility and specifically draw (which is required because of the distortion during the re-form process). Heat is then applied to the rear of the film so that the release coating forms a film with the ink, partially bonding with it, which further increases the adhesion and transfer to the pulp. At this stage the printed film is stable and can be transported or stored if required. Once ready for use the film is used either in pre-cut pieces or direct from a roll. As the product emerges from the preliminary mould, it is retained on the male component of the mould by suction applied through the vents in the mould designed for this purpose, and for the purpose of steam extraction. The film is placed onto the planar surfaces designed to receive it. Then the female mould is re-applied and heat applied, typically 150 degrees Celsius, for one second combined with a pressure of 400 Kpa. Referring to FIG. 3, in this methodology, the printed design is applied to the conical outer surface of the pre-form 22 by a resilient pad 29, such as that known as a Tampo (trade mark) pad or similar, which is sufficiently malleable to facilitate printing onto uneven surfaces. Pad Printing is a relative of gravure printing. The inked image is created on an etched flat plate (cliché) in a manner similar to gravure (in the surface rather than proud or in relief as in letterpress or flexographic printing). A large, resilient silicone rubber pillow (the pad) is pressed against the cliché. The ink pattern is transferred to the pad, which is subsequently pressed against the substrate (in this case the pulp pre-form). Process (4 colour) printing can be accomplished by using several printing stations in sequence. The key feature of pad printing is the ability to print highly irregular surfaces. The resilient pad transferring the ink can conform intimately to surprisingly asymmetric and uneven surfaces. The resilient transfer pad lifts the image from the plate (cliché) etched with the decorative image prior to engaging the pad with the outer surface 20 of the pre-form 22. The printed pre-form 22 is then moulded to the final product 12 as previously described.

Figure 4:
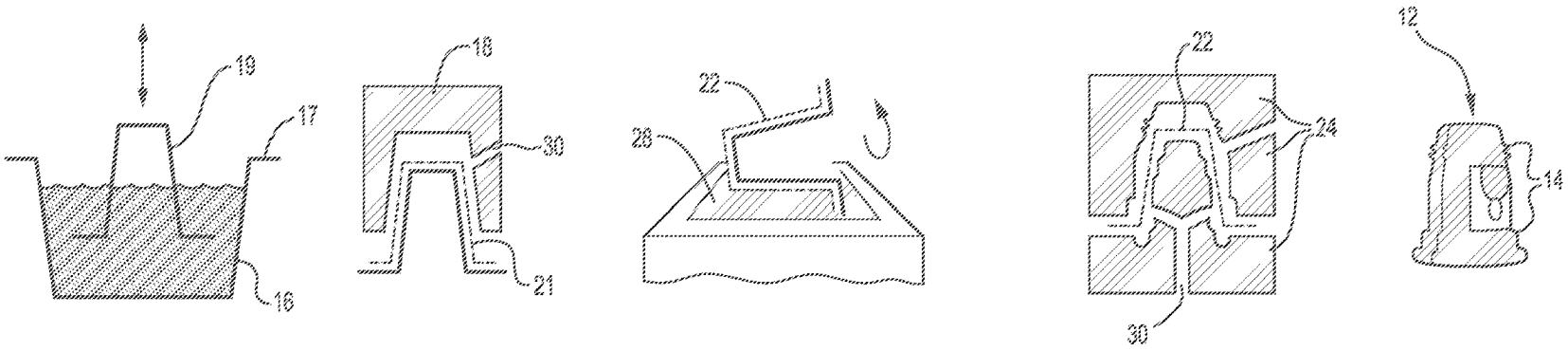
FIG. 4 is a schematic illustration of a still further embodiment of the invention.

FIG. 4 illustrates a methodology wherein the pre-form 22 is printed using a screen printing technique. The screen mesh 28 is contacted by the surface of the pre-form 22 and the print is applied from the screen to the pre-form surface. The screen mesh 28 may be rotated around the axis of the pre-form 22 or the pre-form may be rotated and rolled along the planar surface of the screen mesh 28. Many forms of screen printing are known and may be adapted for use in embodiments of the present invention.

Figure 6:
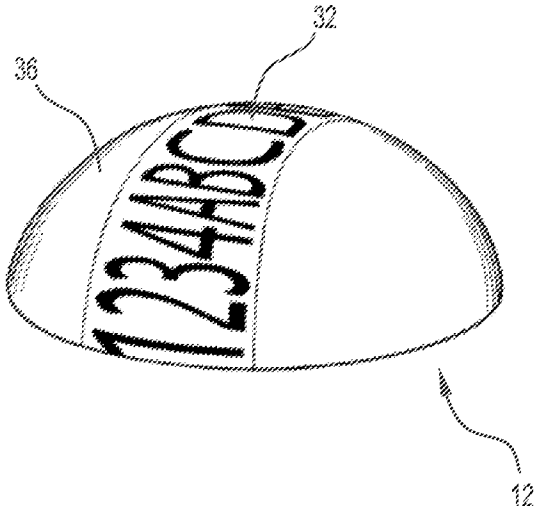
FIG. 6 is a perspective view of the final moulded product of FIG. 5.
Figure 5:
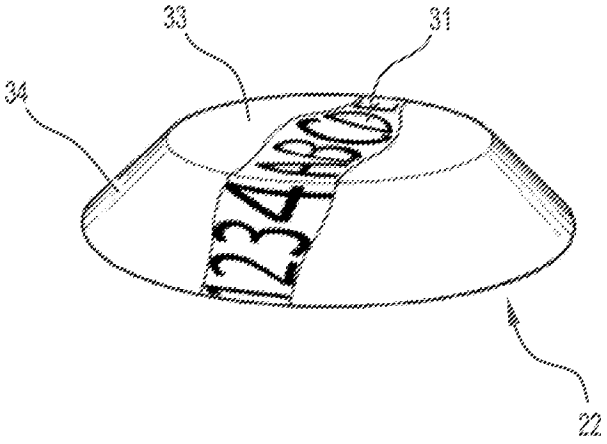
FIG. 5 is a perspective view of a printed pre-form of one embodiment of a product moulded from pulp material in accordance with an embodiment of the invention.
Figure 8:
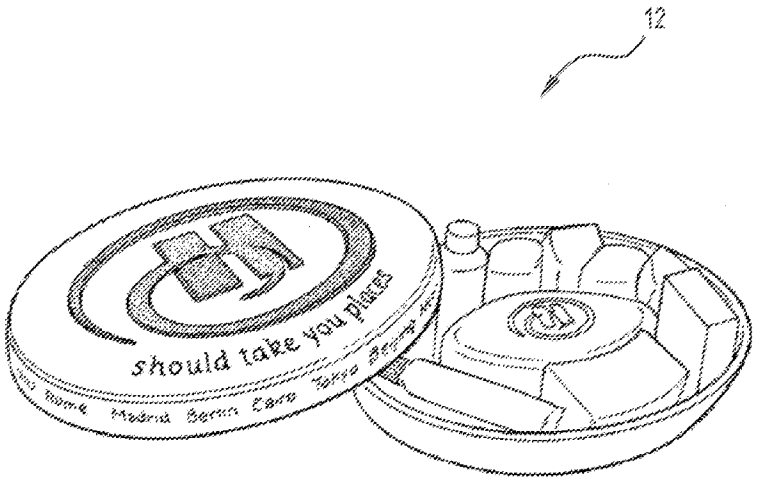
FIG. 8 shows another example of the invention.
Figure 7:
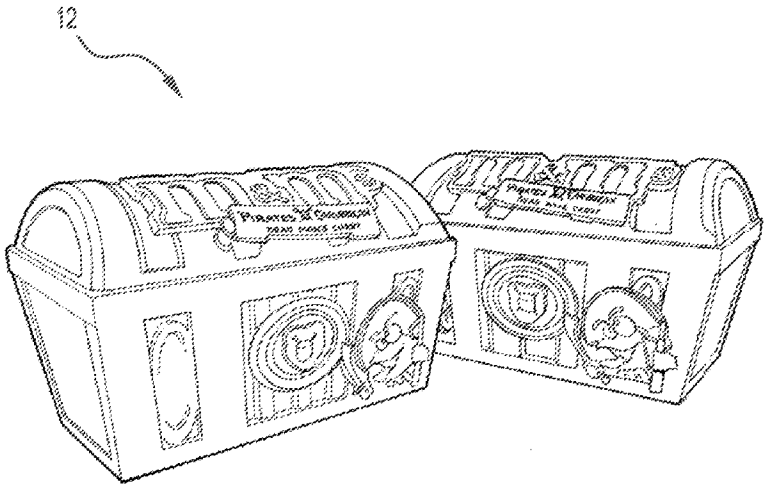
FIG. 7 shows the detailed packaging available from the invention when applied to a popular confectionery product.

As shown in FIGS. 5 and 6, a product 12, having a complex outer surface shape moulded from pulp material, in this case, a hemispherical bowl, can be printed or decorated in such a manner that decorative material in the form of letters, codes, logos or the like printed as an anamorphic projection 31 on the conical side surface 34 and planar top surface 33 of the pre-form 22 is recognisable and identifiable when the pre-form 22 is re-shaped to exhibit the complex curved surface 36. In the embodiment illustrated, the lettering 31 as an anamorphic projection is able to be printed by simple printing techniques on the flat top surface 33 and two dimensional side surface 34. The final moulding process causes the printed material to change shape to exhibit the desired properties.

As previously discussed, these prior art techniques whilst providing some improvements on the earlier art are still subject to a range of limitations including reliance of the provision of the printing materials for application to the pre-moulds which take the form of silicon coated paper or various polymer webs. Moreover, these technologies are used for the application of substantially one off print runs. Whilst a degree of semi-automation can be applied the processes still essentially remain one step processes and are not well adapted for full automation and continuous batch lot productions as is commonly found in the general printing industry.

A first embodiment of the invention will now be described with reference to FIGS. 9 to 12.

Figure 9:
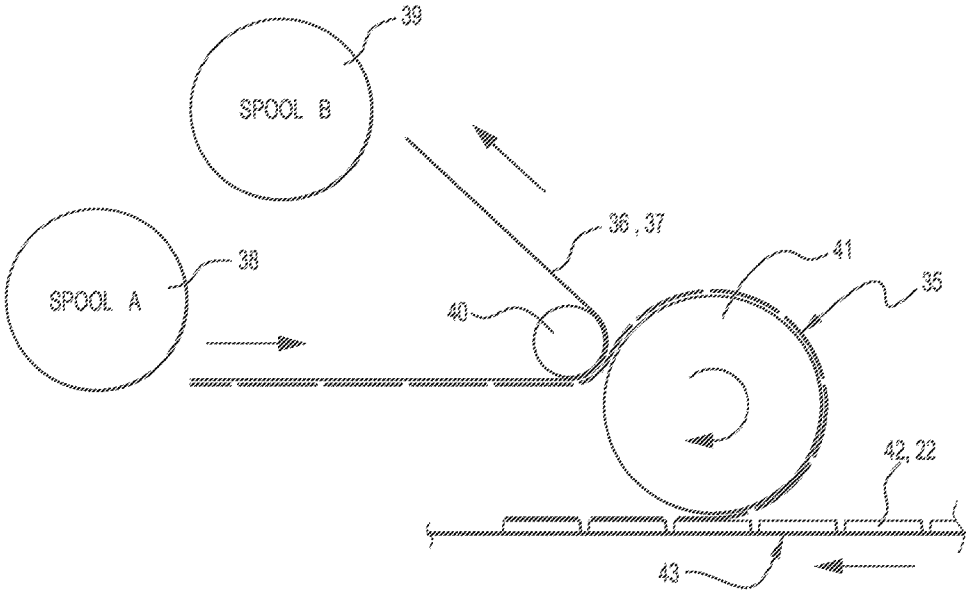
FIG. 9 shows the use of a carrier web to apply print to intermediate transfer surface.

In FIG. 9 the printed decoration is applied to an intermediate transfer surface 36. The intermediate transfer surface may be a carrier web (paper, film, etc) which is stored on a feeder spool 38. The feeder spool feeds the carrier web 37 to a take-up spool 39 via a tensioning roller 40. The tensioning roller 40 pushes the carrier web or film 37 tight and applies pressure onto the film and a transfer roller 41. The Transfer roller 41 is a large Teflon coated roller, which may contain small holes and is used to deliver the printing to the wet pulp 42. The rollers 40, 41 plus the spools 38, 39 are held in a frame in such a way that they can be moved together, so that the Transfer roller 41 can make contact with the wet pulp 42 with varying, designed, levels of pressure, without affecting the efficient transfer of decoration to the transfer roller itself from the carrier web. The Wet pulp 42 is itself on a conveyor belt 43 which moves in the direction shown, and at a speed which is in direct relation to the speed of the rotating transfer roller 41.

Figure 10:
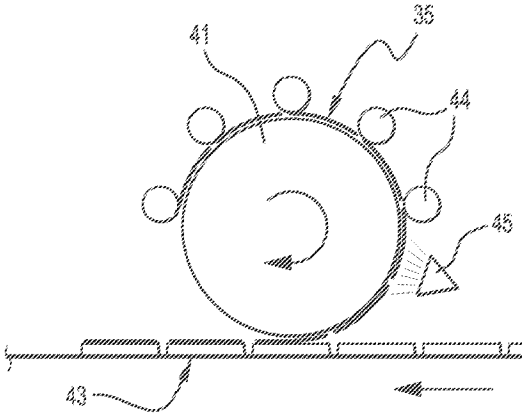
FIG. 10 shows the use of print heads to apply print.

In a further embodiment of this process as shown in FIG. 10 the transfer roller 41 can receive print directly via print heads 44. In a similar technique to dry offset letterpress which prints directly to a transfer cylinder then applies the ink to the final product. The ink is then typically cured by the use of a UV light source 45. However, the process of the invention can cure the inks on the transfer cylinder prior to contacting the now dry ink membrane to the surface of the wet pulp. The release layer would also be applied in this manner but would be activated by UV instead of heat, as illustrated in FIG. 10.

In both the previously detailed embodiments the provision and delivery of the printing 35 by way of the intermediate transfer surface 36 is provided by a rotating transfer roller 41. The rotating transfer roller provides a highly efficient method of delivering the print 35 as a continuous and highly automated process where the rotation of the transfer roller continuously follows or co-ordinates with the movement of the wet pulp 42 so as to rapidly apply the print to the wet pulp in a continuous and highly automated fashion. In this manner, the speed of delivery is limited only by the ability of the transfer roller to accept print and deliver same to the wet pulp 42 which is being moved by a suitable conveying system.

The rotating transfer roller therefore provides highly novel apparatus feature of the invention which allows the otherwise one by one application of printing to a pre-form to be highly automated as a continuous application of printing, not necessarily to the pre-form; but instead of using a pre-form, being applied directly to the wet pulp or pulp sheet material per se. The wet pulp can be printed either prior to preparation of the pre-form or after the preparation of the wet pulp into the pre-form stage. The additional advantage of the use of the transfer roller is shown in FIG. 10 where the print 35 can be applied directly to the transfer roller 41 by way of a plurality of print heads 44 positioned around the transfer roller. In this manner the print heads directly apply the print 35 to the transfer roller in a highly controlled manner including the ability to provide a variety or sequence of different prints which can be controlled from each separate print head.

The ability to control the print can be further enhanced by the use of curing facilities including a UV curing lamp 45 such that the print can be applied to the transfer roller in a highly controlled and precise manner with a precise amount of release required to transfer the print from the print roller to the wet pulp or pre-form. In the instances where the print may require assistance with adhesion to the wet pulp an additional step can be incorporated including the application of appropriate adhesives to the wet pulp so as to ensure appropriate adhesion occurs.

Continuous Sheet Pulp Moulding

Figure 11:
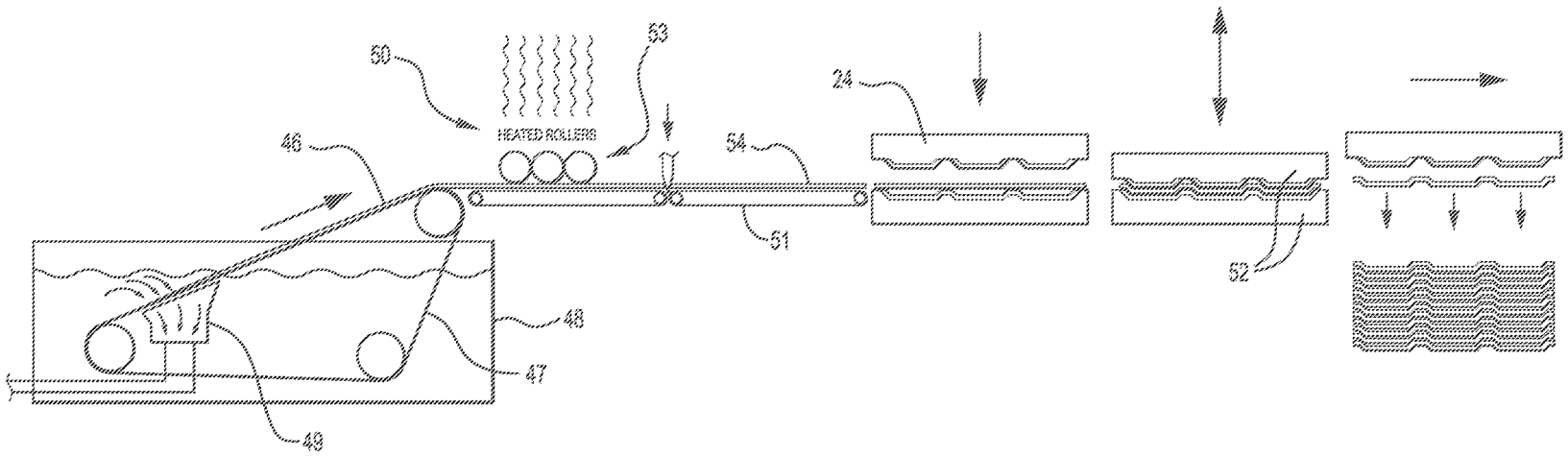
FIG. 11 shows an automated production line.

Further to the invention as so far described, a continuous sheet as shown in FIG. 11, typically referred within the industry as a continuous web 46, of pulp fibre is provided. The benefits in creating such a web include reducing the time spent in creating the initial pulp pre-form in the initial stage of the process which requires the cycle of forming be complete and the partly formed part forwarded on to the next stage prior to the forming tool returning to the tank to begin the manufacture of the next part. The deforming of semi wet pulp into new forms and increasing the level of deformation has characterised deformation parameters for different fibre types and blends; and level of deformation that could be achieved through the deformation of a planar web of semi wet pulp fibre. The method of manufacture provided by the invention reduces the need for the pre-forming tooling as used in the prior art. Printing onto the semi-wet web would then be discretionary. However, if printing was applied it would be applied prior to the secondary forming and drying stage as outlined in the prior art. The development of the current invention would therefore provide benefit from a reduction in costs due to increased line speed and no requirement for pre-moulds.

Further to this development it is advantageous to review the design of the forming mesh upon which the web is created. Typically the pulp fibre is drawn onto a mesh forming tool through suction with the water being sucked through the mesh and the pulp fibres building up on the mesh, small fibres or fines are pulled through and typically removed through the use of a centrifuge system. FIG. 11 shows a forming mesh in the form of a belt 47 which is cycled through the pulp holding tank 48 and then over a suction head 49 with the time taken to cross this head being directly related to the build up of fibre on the web. As the web clears the tank it is then passed between a heated mandrel 50 and a further suction head (not shown) to reduce moisture content and through compression can set the dimensional tolerance and density of the pulp web 46. The pulp web 46 is now in a semi-wet form and has a degree of structural integrity such that the pulp having left the forming mesh can be propelled along the manufacturing path by the web forming behind and potentially assisted by delivery belts 51. The semi-wet pulp web can now be decorated by transferring the pre-printed ink membrane via the intermediate transfer surfaces 36 onto the planar pulp web. The decorated or undecorated semi-wet pulp web now enters the forming station 52. The forming station deforms the semi-wet pulp into its final form while also drying the pulp. The forming station can either have a rotary design or can have a straight press design as shown in FIG. 11 which would track with the movement of the web during the period of drying and deformation. The trimming of the product can occur either within this final forming tool or as a post forming stage. In this automated embodiment of the invention the design of the initial suction head 49 within the pulp holding tank 48 could also be modified to vary the suction on different parts of the web which would allow local control of pulp density which could be used to allow greater scope for deformation or for increasing localised pulp density which could be beneficial for product strength or to create a tactile difference to the finished pulp product.

Figure 12:
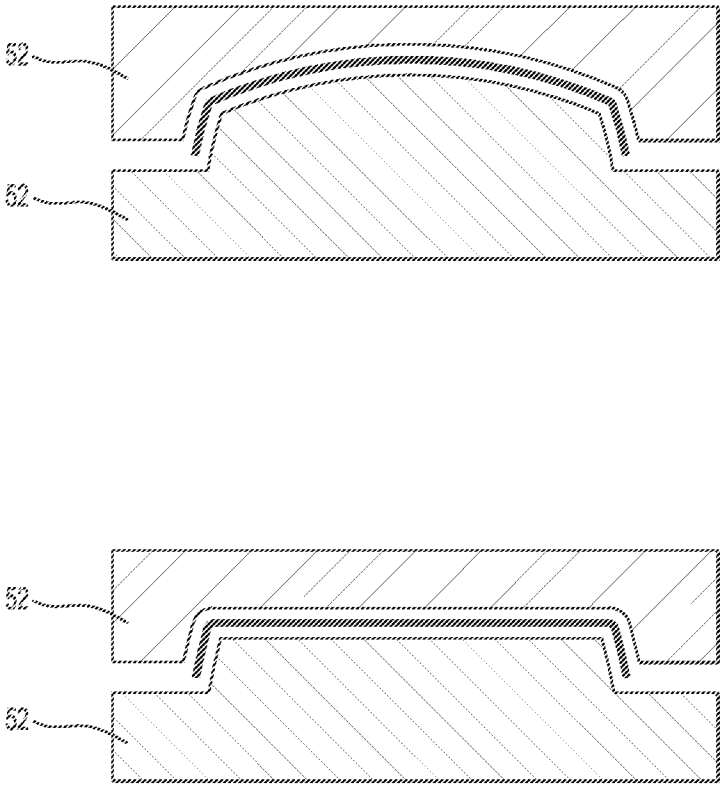
FIG. 12 shows a transfer roller applying print to a batch run of pre-forms.
Figure 12:
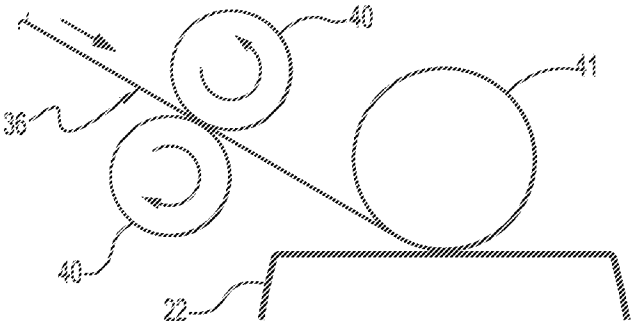
Figure 13:
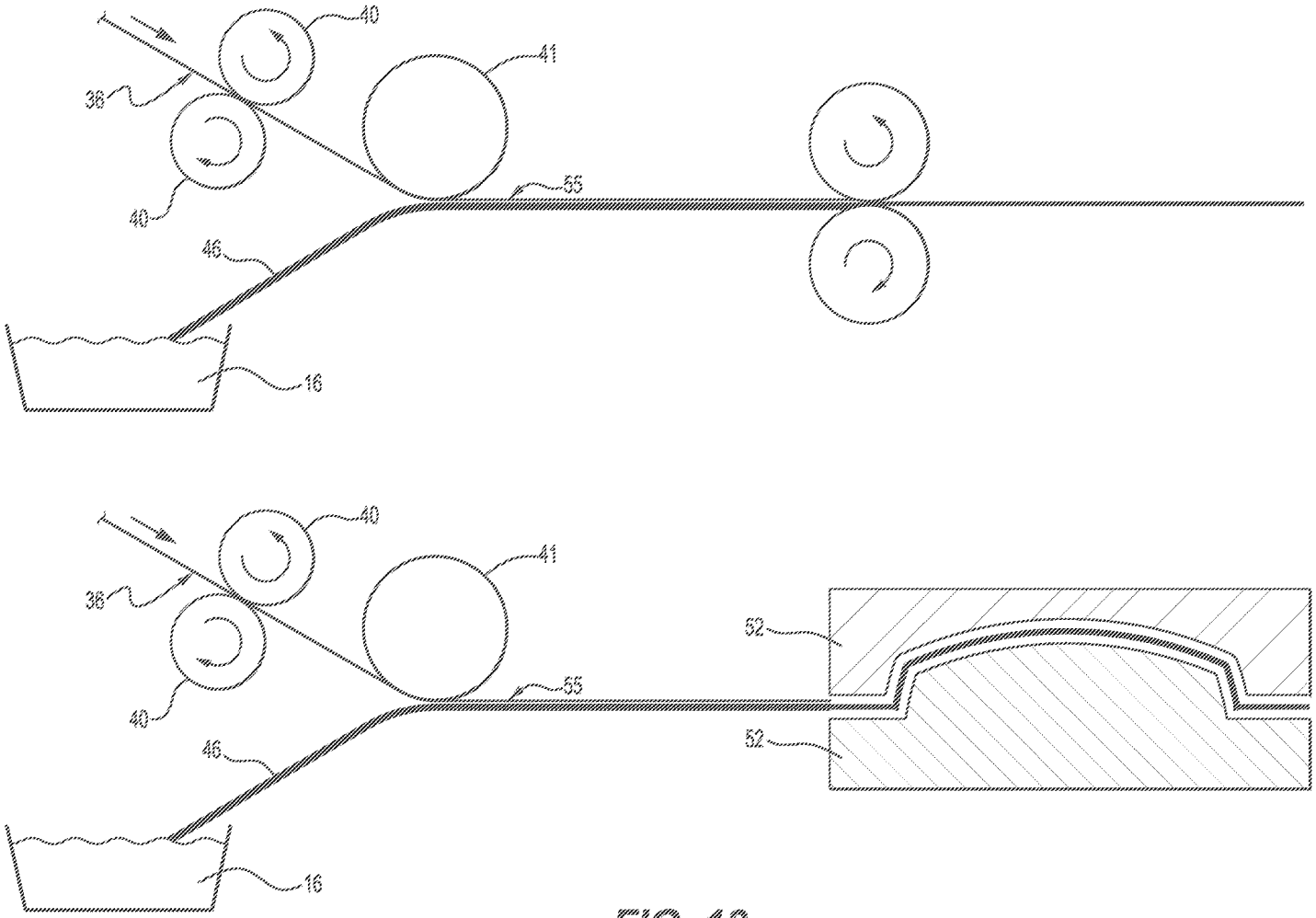
FIG. 13 shows a transfer roller applying print to a continuous pulp sheet.

Referring now to FIGS. 12 and 13 a variation of the use of the transfer roller as previously described is shown with FIG. 12 showing the transfer roller 41 applying printing by way of the intermediate transfer surface 36 which is tensioned under tensioning rollers 40 and being applied to pre-forms 22 which are transferred by way of a conveyor belt.

Alternatively, the transfer roller can be applied as shown in FIG. 13 where a continuous web of wet pulp sheet is drawn from a slurry pool 16 and in an analogous manner to that applied to the pre-form 22, the printing is applied by way of the intermediate transfer surface 36 in a continuously operating manner to the wet pulp sheet material 46 being drawn from the slurry 16 by way of a conveyor system.

A further embodiment of the invention can be understood by combining FIGS. 11 and 13 where the constant pulp mat is fed from a slurry pool 16 to a conveyor belt with the printing decoration being delivered directly to the continuously formed pulp mat prior to the moulding stages. The carrier web is matched to the pulp fibre being used for the pulp mat. The carrier web carries the printing decoration and may also carry a dried, water activated adhesive on the side opposite the printing decoration.

In one particularly preferred embodiment the carrier web is formed of a fibre material compatible with the substrate pulp mat wherein the printing being delivered and the carrier web per se are melded together into a single integrated pulp mat. The transfer roller 41 serves to assist in the controlled delivery of the carrier web/printing to the pulp mat to ensure faithful melding or integration there with.

The use of a carrier web of compatible materials and construction to that of the substrate pulp, either as a continuously formed pulp mat or as pulp pre-forms mean that the print does not need to release from the carrier web and that the carrier web has limited waste. The fibre based carrier web would contact the wet pulp pre-form or continuously formed pulp mat and would adhere to the surface through a mixture of mechanical bonds and surface tension, further adhesion could also be applied through the use of spray adhesives applied at the point of contact or in dried adhesive coatings applied to the carrier web that are activated by moisture or other methods to bond to the underlying pulp pre-form or continuously formed pulp mat. The carrier web when applied to the pulp pre-form or continuously formed pulp mat would then be bonded more fully by the application of heat and or pressure into a singular surface. The now decorated pulp pre-form or continuously formed pulp mat would then be capable of being compressed and dried to a predetermined specification or of being deformed and dried to predetermined specifications.

Further benefits of the embodiment of the invention include the ability of the fibre carrier web to add a high quality surface finish, higher gloss or matt finishes, tactile or visual properties, such as the by addition of metallic flecks or mica etc or be capable of adding specific physical properties, such as increased moisture barrier or anti-fungal properties.

In this manner the intermediate transfer surface or carrier web is rolled out on top of the web pulp mat 46 with the adhesive if required touching the carrier mat and the printing facing up.

Once the printing step is executed the pulp mat can then be formed directly with or without the use of an intermediate pre-form. The moulding process therefore creates the final shaped product and at the same time the fibres of the carrier web adhere to and meld with the fibres of the pulp mat. In this manner the printing decoration remains on the surface of the product and serves to decorate or print the final product in all three dimensions.

The invention thus facilitates the manufacture of a multitude of moulded products using pulp material, the moulded products having complex shapes which, nonetheless, are able to be printed or decorated to produce attractive, aesthetically pleasing and/or informative products.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A method of forming a molded and printed product from pulp material including the steps of:

a) forming a wet pulp pre-form from the pulp material;

b) applying a dry or cured printing decoration ink membrane bespoke coating to said wet pulp pre-form using an intermediate transfer surface, being separate and distinct from said pre-form, to form a printed pre-form;

c) transferring the printed pre-form to a mold; and d) molding or re-molding said printed pre-form to form said molded and printed product.

2. The method of claim 1 in which the pulp material is a pulp slurry and the pre-form is formed by a pre-form mold, wherein the step of forming the wet pulp pre-form is by transferring the pulp slurry to the pre-form mold, the preform mold having one or more planar surfaces, compound conjoined planar surfaces and/or two-dimensional curved surfaces.

3. The method of claim 1, wherein the step of applying the printing decoration of step (b) is the step of applying the printing decoration to said planar and/or two-dimensional curved surfaces in a pre-distorted configuration so as to form a post distortion configuration on said molded and printed product.

4. The method according to claim 1 wherein said semi wet pulp pre-form is supplied in the form of a continuous planar sheet or continuous planar web of pulp fiber.

5. The method according to claim 1, wherein said application of said printing decoration to said wet pulp pre-form is assisted by the introduction of adhesives.

6. The method according to claim 1, wherein said intermediate transfer surface is any one of or a combination of a carrier web and/or an intermediate transfer roller.

7. The method according to claim 6, wherein the intermediate transfer surface is the intermediate transfer roller, wherein the intermediate transfer roller applies the printing decoration to said wet pulp.

8. The method according to claim 6, wherein said intermediate transfer roller controls the release of said printing decoration reducing the amount of release required for transfer of said printing decoration to said wet pulp pre-form.

9. The method according to claim 6, wherein said intermediate transfer surface is a carrier web of fiber material compatible with said wet pulp pre-form such that application of said printing and said intermediate transfer surface result in the melding and integration of said printing and said intermediate transfer surface with said wet pulp pre-form into a single integrated printed pulp mat.

10. The method according to claim 6 including a conveyer movement of said wet pulp pre-form at a speed commensurate with the speed of rotation of said intermediate transfer roller.

11. The method according to claim 7, wherein said printing decoration is applied to said intermediate transfer surface via one or a plurality of print heads co-operating with said transfer roller.

12. The method according to claim 11 including the step of curing printing ink from the print head on said transfer roller prior to application of said printed ink to said wet pulp pre-form.

13. The method according to claim 6, wherein said carrier web is fed from a feeder spool to a takeaway spool via a tensioning roller so as to co-operate with said intermediate transfer roller for delivery of said printing decoration to said wet pulp pre-form.

14. The method according to claim 2, wherein the step of forming a wet pulp pre-form comprises preparing a pulp slurry in a pulp holding tank having a forming mesh belt for moving across a suction head so as to deliver a continuous planar sheet of semi wet pulp pre-form to a station which performs the step of applying printing decoration.

* * * * *